US005279450A

United States Patent [19]

Witt, Jr

[11] Patent Number: 5,279,450

[45] Date of Patent: Jan. 18, 1994

[54] CONTAINER WITH TWO SEPARATE CHAMBERS

[76] Inventor: Donald C. Witt, Jr, 1021D Sibley St., Folsom, Calif. 95630

[21] Appl. No.: 82,011

[22] Filed: Jun. 23, 1993

Related U.S. Application Data

[63] Continuation-in-part of Ser. No. 995,784, Dec. 23, 1992, abandoned.

[51] Int. Cl.[5] ..... B67D 5/40

[52] U.S. Cl. ..... 222/377; 222/324; 222/464

[58] Field of Search ..... 222/377, 382, 383, 464, 222/323, 324, 328, 584

[56] References Cited

U.S. PATENT DOCUMENTS

| | | | |
|---|---|---|---|
| 524,245 | 8/1894 | Chameroy | 222/377 X |
| 727,660 | 5/1903 | Masterson | 222/382 |
| 1,688,372 | 10/1928 | Barker | 222/377 X |
| 1,900,668 | 3/1933 | Roselund | 222/324 |
| 2,403,242 | 7/1946 | Schweppe | 222/584 |
| 2,465,023 | 3/1949 | Leonard | 222/377 X |
| 2,583,821 | 1/1952 | Du Bois | 222/464 |
| 4,010,860 | 3/1977 | Garber | 215/1 |
| 4,065,536 | 12/1977 | Lucas | 264/98 |
| 4,221,291 | 9/1980 | Hunt | 206/222 |
| 4,279,349 | 7/1981 | Aigner | 222/129 X |
| 4,637,934 | 1/1987 | White | 426/117 |
| 4,940,186 | 7/1990 | Tada | 222/383 X |
| 4,953,706 | 9/1990 | Pillard | 206/603 |
| 5,048,723 | 9/1991 | Seymour | 222/81 |
| 5,056,674 | 10/1991 | Swartley | 215/31 |
| 5,083,683 | 1/1992 | Knickerbocker | 222/382 |
| 5,123,570 | 6/1992 | Dubow et al. | 222/83 |
| 5,123,575 | 6/1992 | Li | 215/1 |
| 5,147,074 | 9/1992 | Battegazzore | 222/383 |
| 5,152,431 | 10/1992 | Gardner | 222/383 X |
| 5,195,664 | 3/1993 | Rhea | 222/382 X |

FOREIGN PATENT DOCUMENTS

| | | | |
|---|---|---|---|
| 918249 | 10/1946 | France | 222/584 |
| 574215 | 9/1952 | Italy | 222/584 |
| 737905 | 10/1955 | United Kingdom | 222/584 |

*Primary Examiner*—Kevin P. Shaver

*Attorney, Agent, or Firm*—John P. O'Banion; John Costello

[57] ABSTRACT

A liquid container having a threaded neck tapering into a non-slip palm rest opposite the finger grooves for easy handling. Both sides continue outward and down to the base which allows the container to stand freely. Within the container a partition means represented by an interior wall or a cavity starts at the base in the corner under the finger grooves and slants in an upward direction towards the neck creating two separate chambers. The top of the interior wall or cavity has a slight curve and an opening that allows the two chambers to communicate fluid there between.

9 Claims, 6 Drawing Sheets 26
18
24
10
12
20
14
22
16

CONTAINER WITH TWO SEPARATE CHAMBERS

CROSS REFERENCE TO RELATED APPLICATIONS

This is a continuation-in-part of co-pending application Ser. No. 07/995,784 filed on Dec. 23, 1991, now abandoned.

BACKGROUND OF THE INVENTION

1. Field of the Invention

This invention relates generally to manually operated pump type dispenser containers, and more particularly, to an improved container with two separate chambers adapted for dispensing atomized fluid in a variety of positions, including an inverted position.

2. Description of the Background Art

Pump type fluid dispensers generally include a suction tube which extends into a container configured to hold the fluid to be pumped. The containers take on different shapes for comfort and style, such as those which use handgrips and non-slip surfaces, but all of the containers merely hold a fluid to be dispensed. The problem with such conventional containers is that the fluid level eventually reaches a point at which the suction tube begins to draw air, particularly when the container is tilted from a vertical position into a horizontal plane or when the container is inverted. When this happens the fluid will spew and sputter from the pump nozzle, rather than spray as it was intended. The spewing of fluid usually ends up dripping from the nozzle, possibly damaging clothing, furniture, rugs, and the like, depending upon the type of fluid being dispensed. Moreover, when the container is inverted, the suction tube sticks straight out of the fluid making it impossible to use.

Therefore, a need exists for a container which can be tilted or inverted, while still maintaining the ability to dispense a fluid. The present invention fulfills that need.

SUMMARY OF THE INVENTION

This invention pertains generally to a fluid container which can be used with a pump type dispenser in a variety of orientations. By way of example and not of limitation, the container of the present invention generally includes two chambers, one small and one large, which are adjacently disposed. A suction tube from a pump type dispenser extends into the small chamber for drawing fluid therefrom. The small chamber automatically fills with fluid whenever the container is oriented such that the water line of the large chamber is above the water line of the small chamber.

Accordingly, several objects and advantages of my invention, are the use of a pump type dispenser in the inverted position without the suction tube sucking air, thus causing the nozzle to sputter and spew fluid.

It is an object of the invention to provide complete consumption of the fluid to be pumped while maintaining a maximum degree of usage.

Another object of the invention is to provide an apparatus for dispensing atomized fluid while in an inverted position.

Another object of the invention is to provide an apparatus which can dispense the majority of the fluid in a container while in an inverted position.

Still another object of the invention is to provide an apparatus for dispensing atomized fluid having a simple, dependable fluid pickup means.

Further objects and advantages of my invention will become apparent from a consideration of the drawings and ensuing description.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
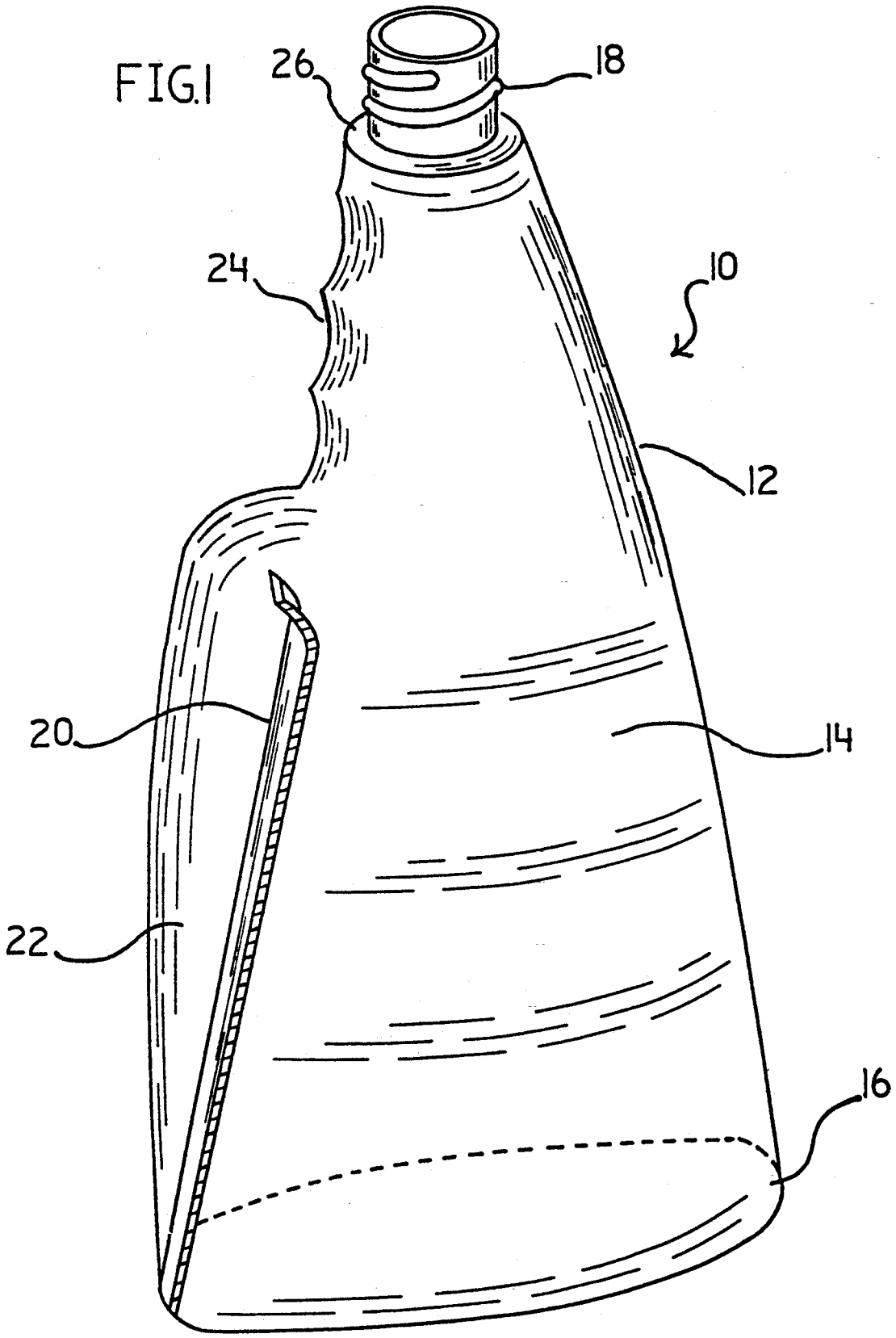
FIG. 1 is a perspective view of a container with two separate chambers according to the present invention.

Referring more specifically to the drawings, for illustrative purposes the present invention is embodied in the apparatus generally shown in FIG. 1. It will be appreciated that the apparatus may vary as to configuration and as to details of the parts without departing from the basic concepts as disclosed herein.

A typical embodiment of the container with two separate chambers in accordance with the present invention is shown at 10 in FIG. 1 as comprising a neck portion 26 with an opening and a conventional type of threading 18 tapering into a non-slip palm rest 12 opposite a finger groove section 26 for easy handling. Below the finger grooves section 24 the container 10 tapers outward and down having two relatively wide walls which wrap around making two relatively narrow walls closing off the container 10 with a base 16 allowing the container to stand upright. The container 10 of the present invention has both a vertical axis and a horizontal axis, the vertical axis extending between the neck portion 26 and the base 16, while the horizontal axis extends between the two relatively wide walls. Within the container 10 a partition means serves to partially divided container 10 into first and second chambers. In the preferred embodiment, one chamber is small and the other is large. A preferred embodiment for a partition means is represented by an interior wall 20 begins at the base 16 in the very most corner below the finger grooves section 24 and slants in an upward direction towards the neck portion 26 at approximately 70 degrees, although several angles may be used. The interior wall 20 ends below the finger grooves section 24 with a slight curve towards the outer wall of the container 10 allowing a large enough opening to fill a small chamber 22 within a few seconds. The interior wall 20 has a complete seal with the two relatively wide walls of the container 10 from the base 16 to the top making a completely separate small chamber 22 with one opening at the top which allows the communication of fluid there between a large chamber 14 and the small chamber 22.

Figure 10:
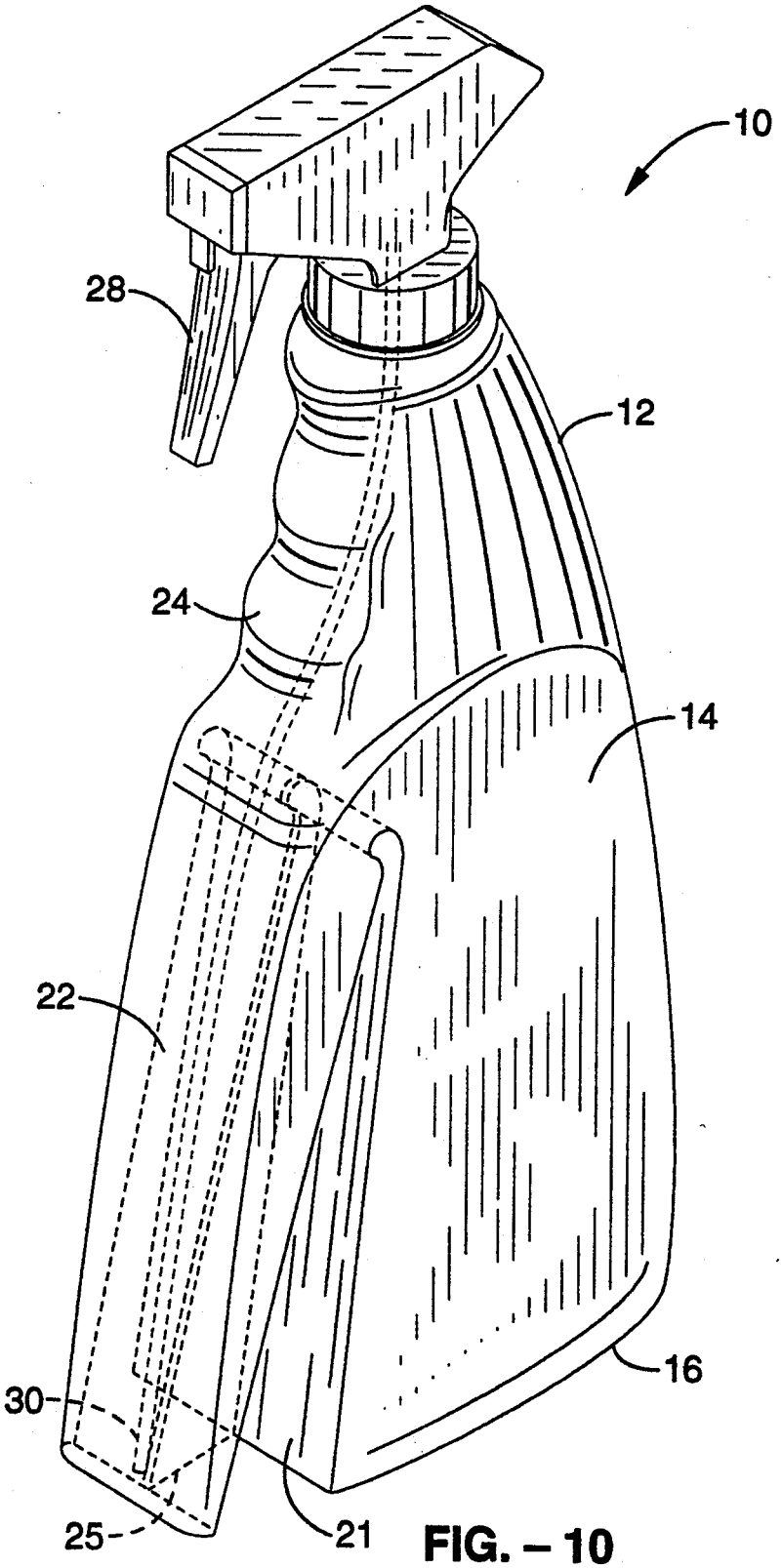
FIG. 10 is a perspective view of an alternative embodiment of the apparatus of the present invention.
Figure 11:
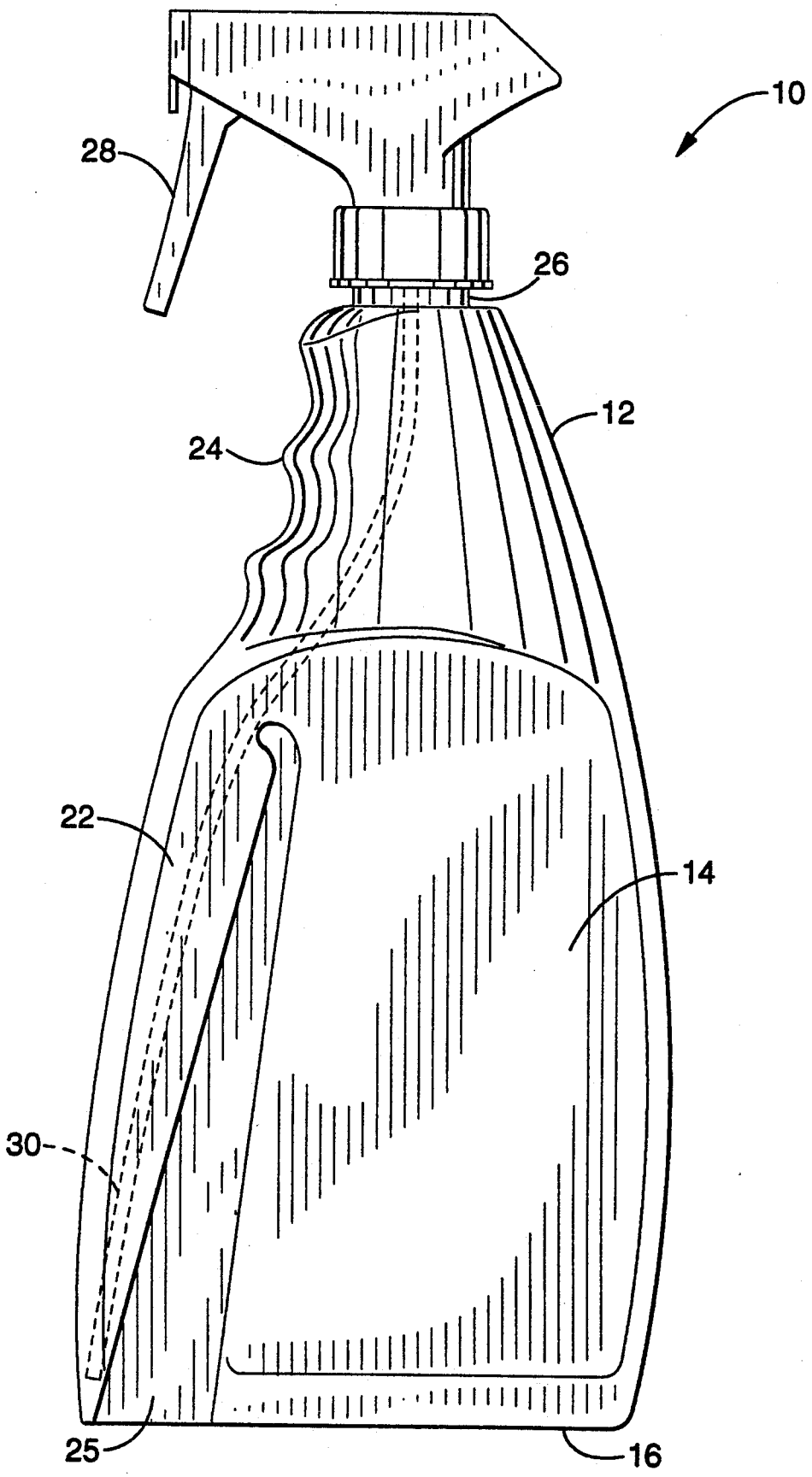
FIG. 11 is a side elevation of the apparatus shown in FIG. 10.

Referring to FIG. 10 and FIG. 11, an alternative embodiment of the present invention is shown in a form which is most practicable for blow molding as a means of fabrication. In this embodiment, interior wall 20, which serves as a partition means to separate the two chambers 14 and 22, is replaced with a cavity 21. Cavity 21 extends upward along the vertical axis of container 10, cavity 21 preferably penetrating in a horizontal fashion bath of the wide walls of container 10 throughout its vertical path. In this way, cavity 21 defines a space separating the two chambers 14 and 22. Cavity 21 has an open end near base 16 and an opposing closed end. In the preferred embodiment, the closed end of cavity 21 has a curved portion, the curved portion serving as a flow restrictor to inhibit the flow of fluids between the two chambers 14 and 22. At its closed end, cavity 21 terminates at a point such that the two chambers 14 and 22 are partially separated. In this way, cavity 21 allows open communication to remain between chambers 14 and 22, thus allowing fluid to flow back and forth between chambers 14 and 22.

Figure 12:
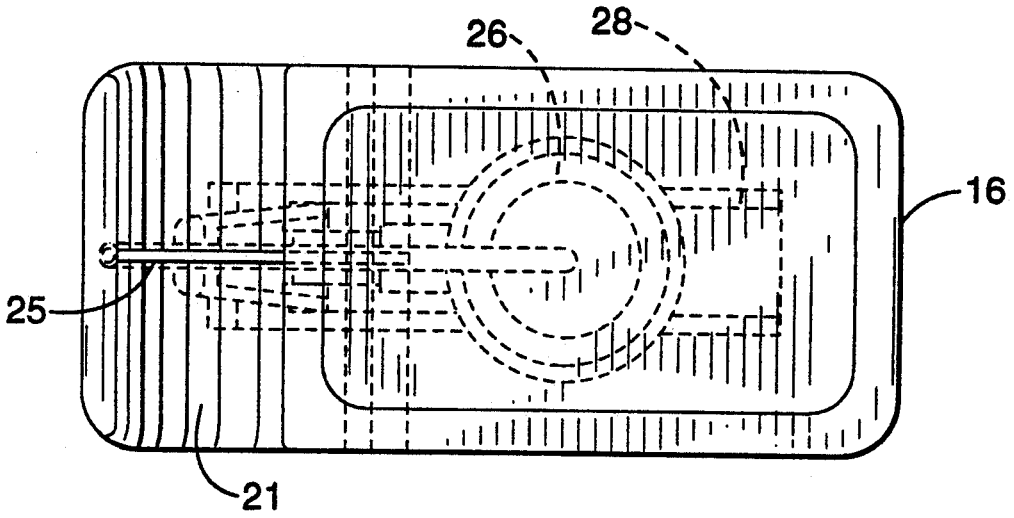
FIG. 12 is a bottom view of the apparatus shown in FIG. 10.

Referring to FIG. 11 and 12, the space defined by cavity 21 preferably has a rigid support member 25 spanning cavity 21 at a central location parallel with the wide walls of container 10 and proceeding upward vertically throughout cavity 21.

A suction tube 30 from a dispensing means which is preferably a manually operated trigger type pump dispenser 28 is placed inside of the small chamber 22 and proceeds to the base 16. Suction tube 30 provides small chamber 22 with a fluid pickup means having a simple, trouble free design. The manually operated trigger type dispenser 28 has preferably an internally threaded portion which allows it to communicate with neck portion 26 and preferably be detachably connected to the neck portions 26 of the container 10. The manually operated trigger type dispenser 28 preferably atomizes fluid in container 10 upon dispensing.

The container 10 may be injected-molded in two halves (to be suitably bonded to each other) from a plastic material.

Figure 3:
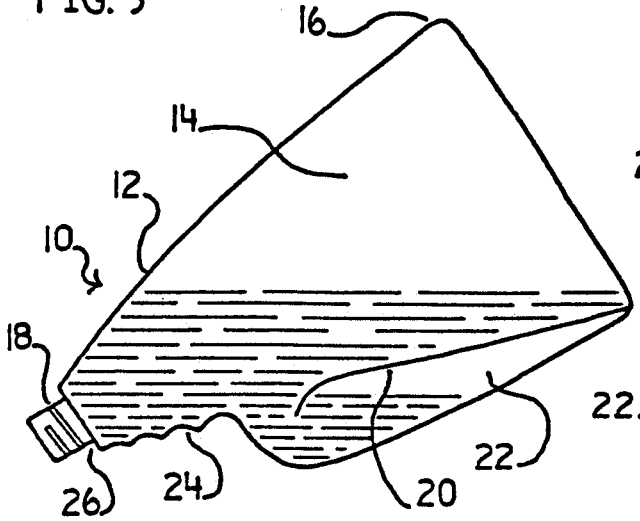
FIG. 3 is a diagrammatic side elevation of the apparatus of FIG. 1 showing the small chamber being filled with fluid when the container is inverted.
Figure 2:
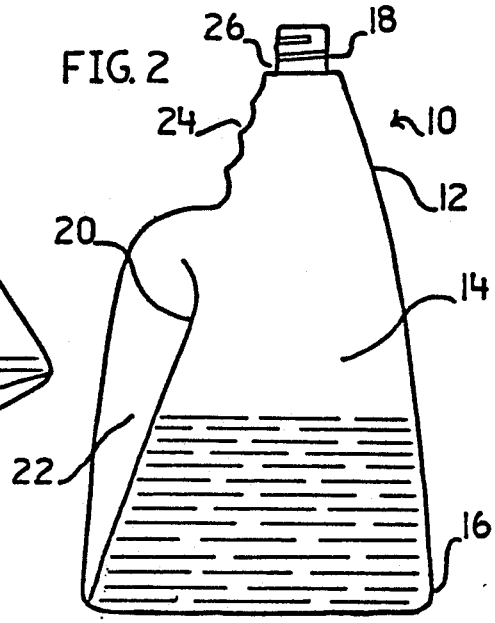
FIG. 2 is a diagrammatic side elevation of the apparatus of FIG. 1 showing fluid in the large chamber.
Figure 4:
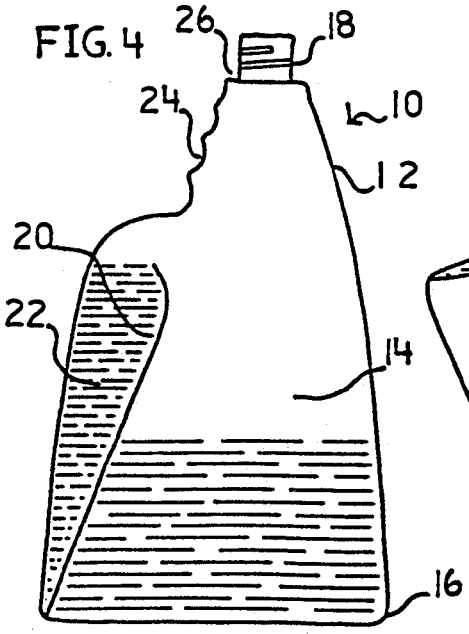
FIG. 4 is a diagrammatic side elevation of the apparatus of FIG. 1 showing the small chamber filled with fluid after being inverted.
Figure 5:
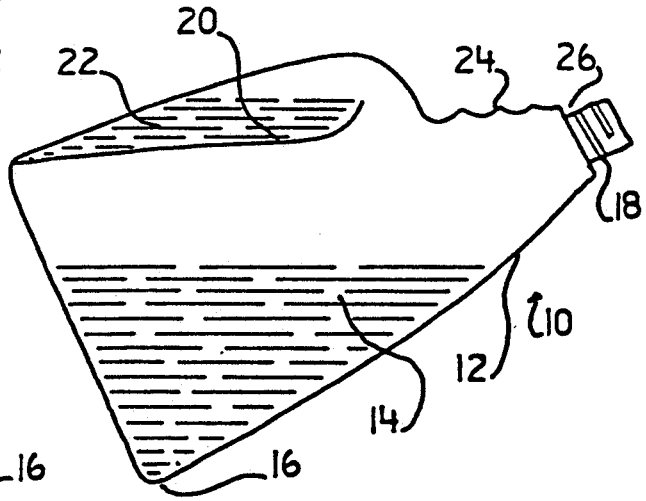
FIG. 5 is a diagrammatic side elevation of the apparatus of FIG. 1 showing the fluid levels in the small and large chambers when the container is oriented for spraying in an upward position.
Figure 7:
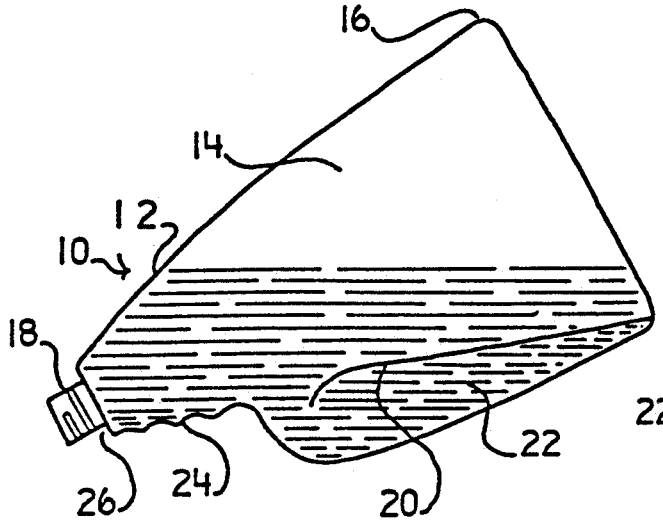
FIG. 7 is a diagrammatic side elevation of the apparatus of FIG. 1 after being partially inverted while air pressure moves to the base of the container and the small chamber remains full.
Figure 6:
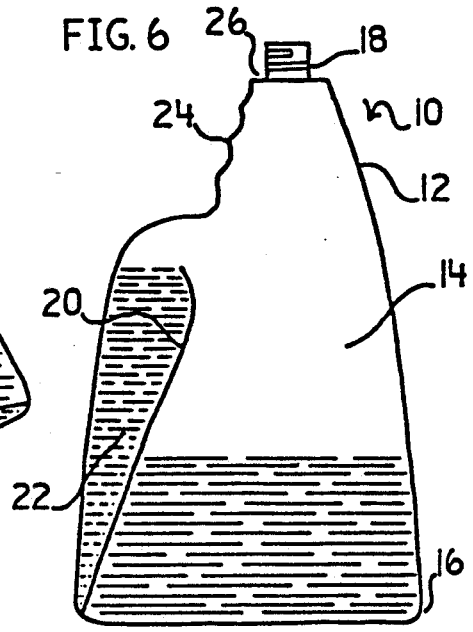
FIG. 6 is a diagrammatic side elevation of the apparatus of FIG. 1 showing the small chamber filled with fluid when the container is oriented in an upright position.
Figure 8:
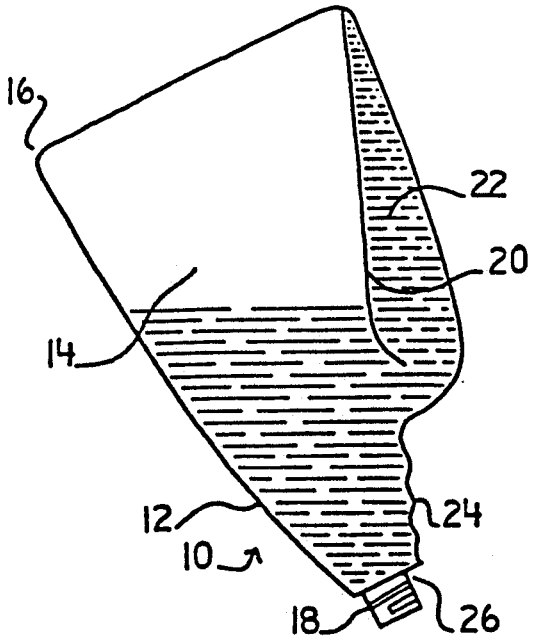
FIG. 8 is a diagrammatic side elevation of the apparatus of FIG. 1 after being inverted while air pressure moves to the base of the container and the small chamber remains full.
Figure 9:
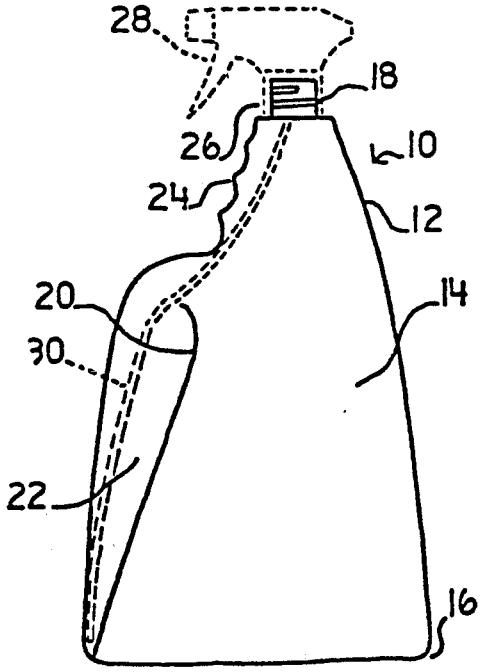
FIG. 9 is a diagrammatic side elevation of the apparatus of FIG. 1 showing attachment of the container to a manually operated trigger type dispenser and the path of a suction tube into the small chamber.

The container 10 is made to store the fluid that is to be pumped by a manually operated trigger type dispenser 28 as shown in FIG. 9 the suction tube 30 from the trigger type dispenser 28 travels down and is inserted into the small chamber 22. The neck portion 26 has an externally threaded portion 18 which can be put into a screw engagement with the cap of the trigger type dispenser 28, thus providing an air-tight seal. The finger grooves sections 24 work in conjunction with the nonslip palm rest 12 to allow comfortable and controlled use. An interior wall 20 within the container 10 provides a separate small chamber 22 to hold fluid and divert air away from the suction tube 30 when the container 10 is in the inverted position. To fill the small chamber 22 the user must simply roll their wrist forward turning the container 10 in an upside down direction and then back to an upright position as shown in FIG. 2, 3, and 4. This process allows a maximum degree of usage until the fluid is completely gone. To enable the user to spray in an upward direction, FIG. 5 illustrates the importance of the slight curve on the top portion of the interior wall 20.

Inverted use of the trigger type dispenser 28 using the container with two separate chambers 10 is possible due to the natural air pressure inside of the container 10. As long as the fluid, when the container 10 is inverted does not go below the opening of the small chamber, 22 the fluid will be drawn from the large chamber 14 into the small chamber 22 where the suction tube 30 of the trigger type dispenser 28 sucks the fluid to be pumped. When the fluid gets too low for inverted use, the small chamber 22 will fill with air, at this time the user should refill the small chamber 22 as shown FIGS. 2, 3 and 4.

The length of the interior wall 20 is in direct relation with how long inverted use may be achieved. Following the refilling of the small chamber 22 the trigger type dispenser 28 should only be used to spray in a downward to an upward position, this may be achieved until the fluid is completely gone. Accordingly, it will be seen that the small chamber of the invention provides the user of the container with a highly reliable, economical way to use all the fluid with a maximum degree of usage. It should also be noted that many other variations are possible. For example the size and shape of the container, or the length and angles of the interior wall, can vary without departing from the invention disclosed herein.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A fluid dispenser, comprising:

(a) dispensing means for dispensing a fluid;

(b) containment means for holding a fluid, said containment means having a vertical axis and a horizontal axis, said containment means including a neck portion, said neck portion coupled to said dispensing means;

(c) partition means for dividing said containment means into a first chamber and a second chamber and allowing said first chamber to communicate with said second chamber;

(d) said partition means including a substantially curved flow restrictor means for inhibiting the flow of said fluid between said first chamber and said second chamber; and (e) a suction tube having first and second ends, said suction tube coupled to said dispensing means at said first end, said suction tube communicating with said first chamber at said second end.

2. A fluid dispenser as recited in claim 1, wherein said partition means further comprises:

(a) a cavity, said cavity extending along said vertical axis of said containment means, said cavity having a first closed end and a second open end;

(b) said cavity penetrating horizontally through said containment mean along said vertical axis of said containment means for a distance extending between said open and closed ends of said cavity, said cavity defining a space between said first chamber and said second chamber;

(c) said closed end terminating in said flow restrictor means, said flow retrictor means inhibiting the flow of fluid between said first chamber and said second chamber.

3. A fluid dispenser as recited in claim 2, further comprising a support member, said support member spanning said cavity at a central location.

4. A fluid dispenser as recited in claim 3, wherein said containment means further comprises a finger groove section, said finger groove section being positioned below said dispensing means.

5. An apparatus for dispensing fluid, comprising:

(a) manually operated dispensing means for dispensing atomized fluid;

(b) a container, said container having a vertical axis and a horizontal axis, said container having a neck portion for communicating with said dispensing means;

(c) partition means for partially dividing said container into a first chamber and a second chamber and allowing said first chamber to communicate with said second chamber;

(d) said partition means including a substantially curved flow restrictor means for inhibiting the flow of said fluid between said first chamber and said second chamber; and (e) a suction tube having first and second ends, said suction tube coupled to said dispensing means at said first end, said suction tube communication with said first chamber at said second end.

6. An apparatus as recited in claim 5, wherein said partition means further comprises:

(a) a cavity, said cavity extending along said vertical axis of said container, said cavity having a first closed end and a second open end;

(b) said activity penetrating horizontally through said container along said vertical axis of said container for a distance extending between said open and closed ends of said cavity, said cavity defining a space between said first chamber and said second chamber;

(c) said closed end terminating in said flow restrictor means, said flow restrictor means inhibiting the flow of fluid between said first chamber and said second chamber.

7. An apparats as recited in claim 6, further comprising a support member, said support member spanning said cavity at a central location.

8. An apparatus as recited in claim 7, wherein said container further comprises a finger groove section, said finger groove section being positioned below said dispensing means.

9. An apparatus for dispensing atomized fluid, comprising:

(a) manually operated dispensing means for dispensing fluid;

(b) a container, said container having a vertical axis and a horizontal axis, said container including a neck portion for communicating with said dispensing means;

(c) said container including a finger groove section, said finger groove section being positioned below said dispensing means;

(d) partition means for partially dividing said container into a first chamber and a second chamber and allowing said first chamber to communicate with said second chamber;

(e) said partition means including a substantially curved flow restrictor means for inhibiting the flow of said fluid between said first chamber and said second chamber; and (f) a suction tube having first and second ends, said suction tube coupled to said dispensing means at said first end, said suction tube communicating with said first chamber at said second end.

* * * * *